US005307572A

United States Patent [19]

Engel

[11] Patent Number: 5,307,572

[45] Date of Patent: May 3, 1994

[54] IRONING MACHINE WITH A DIFFERENTIAL-PRESSURE REGULATING DEVICE

[76] Inventor: Harald Engel, Birkenweg 24, A-2380 Perchtoldsdorf, Austria

[21] Appl. No.: 862,484

[22] Filed: Apr. 2, 1992

[30] Foreign Application Priority Data

Apr. 3, 1991 [DE] Fed. Rep. of Germany ..... 4110761

[51] Int. Cl.[5] ..... D06F 71/10

[52] U.S. Cl. ..... 38/43; 100/269 R

[58] Field of Search ..... 38/1 C, 1 D, 15, 17, 38/24–27, 31, 33, 35, 37, 40, 41, 43, 16, 23, 32, 36; 100/264, 269 R, 273, 274, 295, 901

[56] References Cited

U.S. PATENT DOCUMENTS

| | | | |
|---|---|---|---|
| 1,979,962 | 11/1934 | Davis | 38/40 |
| 2,026,508 | 12/1935 | Johnson | 38/40 |
| 2,080,915 | 5/1937 | Hanney | 38/16 X |
| 2,116,143 | 5/1938 | Dewey | 38/41 |
| 2,332,830 | 10/1943 | Pearson | 38/1 D |
| 2,382,224 | 8/1945 | Hicks | 38/1 D |
| 2,398,325 | 4/1946 | Preston | 38/1 D |
| 3,156,053 | 11/1964 | Mullejans et al. | 38/40 |
| 3,279,106 | 10/1966 | Tucker | 38/40 |
| 3,333,355 | 8/1967 | Tucker | 38/40 X |
| 3,500,567 | 3/1970 | Tucker et al. | 38/41 X |
| 3,942,432 | 3/1976 | Cantine, Jr. et al. | 100/901 X |
| 3,974,764 | 8/1976 | Horton, Jr. et al. | 100/269 R |
| 4,030,962 | 6/1977 | Fitzwater | 38/26 X |
| 4,208,935 | 6/1980 | Kollmar | 100/269 R X |
| 4,492,154 | 1/1985 | Rupp et al. | 100/269 R X |
| 4,843,745 | 7/1989 | Oberley | 38/35 X |
| 4,862,608 | 9/1989 | Miyata | 38/31 |
| 5,140,895 | 8/1992 | Imanishi | 100/269 R X |

FOREIGN PATENT DOCUMENTS

| | | | |
|---|---|---|---|
| 0472166 | 3/1951 | Canada | 38/27 X |
| 0053040 | 1/1967 | Fed. Rep. of Germany . | |
| 2939351 | 4/1981 | Fed. Rep. of Germany | 38/1 C |
| 3921024 | 1/1991 | Fed. Rep. of Germany . | |
| 1030599 | 7/1986 | Japan | 38/27 |

*Primary Examiner*—Clifford D. Crowder
*Assistant Examiner*—Ismael Izaguirre
*Attorney, Agent, or Firm*—Wegner, Cantor, Mueller & Player

[57] ABSTRACT

An ironing machine with a computer-assisted control device for the advancing pressure and the pressing time between an upper and a lower shaping board (10, 16) which are movable relative to one another both vertically and horizontally, the ironing machine has a differential-pressure regulating device (1 to 6, 11) which, during the computer-controlled application of pressure to the article to be ironed, takes into account the dead weight of the movable shaping board, as a rule the upper shaping board (10). A substantially higher ironing quality, especially where sensitive textiles are concerned, can be achieved by the invention, because the ironing pressure can be preselected reproducibly within very fine steps.

12 Claims, 1 Drawing Sheet

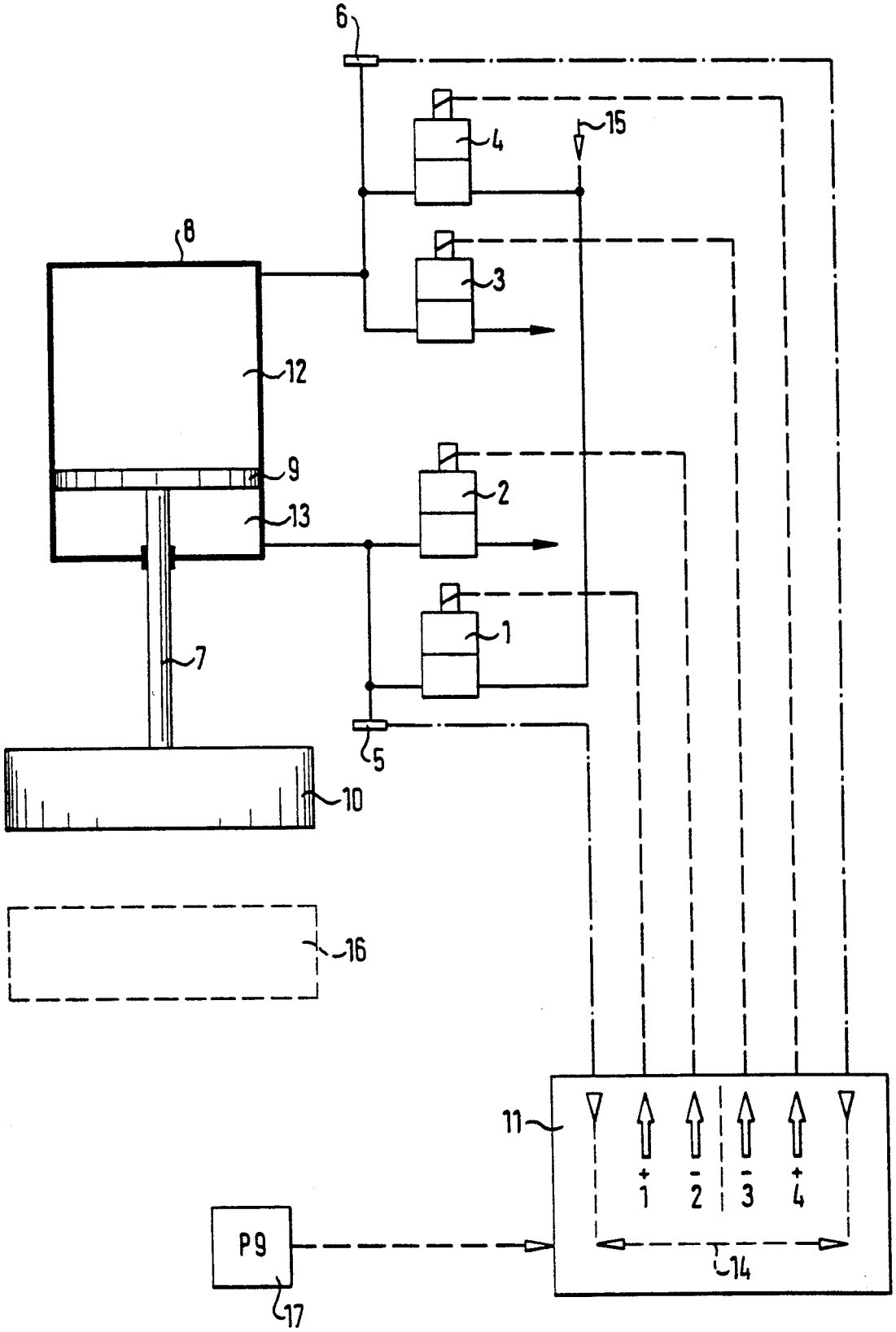
6
4
15
8
3
12
9
2
13
1
7
5
10
16
11
+
1
-
2
-
3
+
4
P9
14
17

IRONING MACHINE WITH A DIFFERENTIAL-PRESSURE REGULATING DEVICE

The invention relates to an ironing machine with a computer-assisted control device and an upper and a lower shaping board which each have an ironing surface on their mutually confronting sides and are horizontally movable relative to one another, at least the upper shaping board being vertically movable by means of a pressure cylinder.

German Patent Specification 3,921,024 C1 describes an ironing machine of the type mentioned, which is equipped with a measuring device in order to determine the shortest distance between the upper shaping board and the article to be ironed which is laid on to the lower shaping board. The distance value determined is further processed in a computer which determines from it the optimum ironing pressure for the article to be ironed and the corresponding ironing time and which transmits them to a pneumatic or hydraulic control device (as described, for example in DD-A-53 040). The measuring device is preferably equipped with contactlessly working distance meters having optical sensors or ultrasonic sensors, and ironing-pressure and ironing-time values can be preset by the computer to match the different types of material.

Values determined empirically are employed to adjust the preset values for the control device via the computer. As has been shown in practice, however, for this either special expert knowledge is demanded or an exact application of pressure to the article to be ironed is impossible, since particularly the dead weight of the upper shaping board, together with technical accessories (piston, piston guide rod and the like) remain neglected, so that the dead weight of the upper shaping board is added to the pressure effect of the pressing cylinder which advances the two shaping boards towards one another. This leads to unacceptable ironing results, at least where some sensitive textiles are concerned.

The object on which the invention is based is to improve ironing machines of the generic type mentioned in the introduction, in such a way that the adjustment of the ironing pressure in relation to the particular article to be ironed does not give rise to any errors, especially as a result of the pressure of the dead weight of different upper shaping boards, each matched to the article to be ironed.

According to the invention the solution for achieving the problem presented is defined by a differential-pressure regulating device which, during the computer-controlled application of pressure to the article to be ironed, takes into account the dead weight of the respective upper shaping board, if appropriate together with accessories, such as a piston rod and fittings, in relation to the ironing surface.

The invention above all prevents the weight of the upper shaping board from being transmitted in an uncontrolled manner to the article (textile material) when the upper shaping board is advanced towards the lower shaping board, that is to say when, with increasing pressure on the upper cylinder chamber of a pressure cylinder displacing the upper shaping board, the associated lower cylinder chamber is sharply deaerated.

The invention makes it possible to apply pressure to the article to be ironed in very small pressure steps.

Furthermore, work can be carried out with very low, exactly reproducible and preprogramable pressures, for example in the low pressure range of 10 p/cm$^2$ to 100 p/cm$^2$. At the same time, the weight of the upper shaping board can be, for example, 20 to 120 kp, depending on the size of the ironing surface and the desired shaping.

In particular, the differential-pressure regulating device according to the invention for ironing machines, in combination with the controlling computer unit, provides that in the computer the pressure value necessary in relation to the respective piston surface of the pressure cylinder of the upper shaping board is maintained in equilibrium with the weight of the respective shaping board or the pressure value to be programmed and to be applied is brought into an equilibrium which is maintained in a controlled manner in each driving position of the pressure cylinder.

An exemplary embodiment of the invention is explained below, together with further advantageous particulars, with reference to the accompanying drawing.

The single figure shows a diagrammatic representation of an ironing machine, in which the differential-pressure regulating device according to the invention is provided in conjunction with the upper shaping board.

All the parts and subassemblies not essential in connection with the invention are not shown or are shown only in diagrammatic outline.

The drawing shows an upper shaping board 10 and a lower shaping board 16. The upper shaping board 10 is connected via one (or more) piston rod or rods 7 to the piston(s) 9 of a pressure/lifting cylinder 8 (a plurality of pressure/lifting cylinders). The vertical position of the piston 9 is determined in a known way by means of different pressure conditions in an upper pressure chamber 12 or a lower pressure chamber 13. These pressure conditions or pressure differences are determined and controlled by a computer 11.

According to the invention, a first pressure sensor 5 is connected to the lower pressure chamber 13 and a second pressure sensor 6 is connected to the upper pressure chamber 12. The pressure values detected by the pressure sensors 5, 6 are transmitted as two input signals to the computer 11 which determines from them pressure values for the upper pressure chamber 12 and the lower pressure chamber 13, taking into account respective dead weight of the upper shaping board (including that of the associated piston rod 7 and piston 9), in such a way that an optimum ironing pressure and the correct ironing time are set automatically in view of the particular article to be ironed.

In order to set the calculated pressure values for the upper pressure chamber 12 and the lower pressure chamber 13, said pressure chambers are connected to respective pairs of aerating and deaerating valves 1, 2 and 3, 4. The aerating valves 1 and 4 are connected to a pneumatic or hydraulic pressure source 15 (not shown), whilst, with a pneumatic pressure source, the deaerating valves 2 and 3 aerate to atmospheric pressure, if appropriate via corresponding filters, pressure-reducing lines and silencers, whereas, where a hydraulic system is concerned, the deaerating valves 2 and 3 are connected to a corresponding vacuum vessel. In the example illustrated, the valves 1 to 4 are electromagnetically actuable valves, the control signals of which are supplied by the computer 11, as represented by broken lines.

Entered in the computer 11 are not only the values, already known from publication DE 3,921,024 C1, for the pressure and ironing time specific to the article to be ironed, but also, via a setting unit 17, the counterpressure values necessary in relation to the piston surface for compensating the weight of the upper shaping board 10. The pressure value P9 indicated diagrammatically therefore corresponds to the shaping-board weight divided by the piston surface of the lower pressure chamber 13. The pressure value to be applied for the upper pressure chamber 12 is entered as a standard value for the current types of upper shaping boards 10 and is calculated by the computer according to the formula $$\text{Shaping-board surface (10)[cm}^2\text{]} \cdot \frac{\text{Programming pressure [p/cm}^2\text{]}}{\text{Surface of piston (9) in upper pressure chamber (12)[cm}^2\text{]}} = \text{counterpressure [p/cm}^2\text{]}$$

The following then applies accordingly to the pressing pressure to be entered via a digital electronic programming system:

$$\frac{\text{Weight of upper shaping board (10) including board carrier [p]}}{\text{Surface of piston (9) in cylinder chamber (13)[cm}^2\text{]}} = \text{pressing pressure}$$

In the programming, when a corresponding digital reading is given, the "programming pressure" is converted into p/cm$^2$ [of the shaping-board surface].

A pressure application controlled in a highly accurate way can thus be achieved in the upper and lower pressure chambers of the cylinder 8 via the electromagnetic valves 1 to 4. This applies to any vertical position of the piston 9, except when the piston 9 bears directly on the cylinder bottom.

The invention is not restricted to ironing machines, in which only the upper shaping board is vertically movable, although this embodiment will be by far the most common. It is evident to an average person skilled in the art that the invention can also be employed on ironing machines, in which either only the lower shaping board can be advanced in the vertical direction or in which both shaping boards can be advanced towards one another in the vertical direction. In an ironing machine in which only the lower shaping board is vertically movable, the considerations set out above for allowing for the weight of the respective shaping board must, of course, be taken into account with opposite signs.

I claim:

1. An ironing machine comprising a computer-assisted control device, upper and lower shaping boards, each having an ironing surface on mutually facing sides, at least one of the shaping boards being vertically movable and having a dead weight, and a differential-pressure regulating device, wherein, during application of ironing pressure to an article, the regulating device, under control of the control device, differentially adjusts the ironing pressure accounting for the dead weight of the at least one shaping board.

2. The ironing machine as claimed in claim 1, wherein only the upper shaping board is vertically movable.

3. The ironing machine as claimed in claim 2, wherein the differential-pressure regulating device includes two pressure sensors which respectively measure the pressure in the lifting/pressure cylinder above and below a piston displaceable within the cylinder, and comprises two pairs of electromagnetic aerating and deaerating valves, one pair of valves is connected jointly to a cylinder lower pressure chamber and the other pair of valves is connected jointly to a cylinder upper pressure chamber, inlets of the two aerating valves being connected on an inlet side to a high-pressure source and outlets of the deaerating valves being connected to a pressure sink.

4. The ironing machine as claimed in claim 3 wherein the high-pressure source is pneumatic.

5. The ironing machine as claimed in claim 3 wherein the high-pressure source is hydraulic.

6. The ironing machine as claimed in claim 2, wherein pressure values of a lower and of an upper pressure chamber of the cylinder are sensed by pressure sensors and are fed into the control device, and wherein control values for pairs of aerating and deaerating valves are processed by the computer, with the at least one shaping-board weight being taken into account, wherein an effective pressure for an advancing shaping board is maintained, during the advance, at least from an advancing value corresponding to a thickness of the article to be ironed and positioned on the other shaping board.

7. The ironing machine as claimed in claim 1, wherein the differential-pressure regulating device includes two pressure sensors which respectively measure the pressure in the lifting/pressure cylinder above and below a piston displaceable within the cylinder, and comprises two pairs of electromagnetic aerating and deaerating valves, one pair of valves is connected jointly to a cylinder lower pressure chamber and the other pair of valves is connected jointly to a cylinder upper pressure chamber, inlets of the two aerating valves being connected on an inlet side to a high-pressure source and outlets of the deaerating valves being connected to a pressure sink.

8. The ironing machine as claimed in claim 7, wherein the pressure values of the lower and of the upper pressure chamber of the cylinder, said values are sensed by the pressure sensors and are fed into the control device, and wherein control values for the pairs of aerating and deaerating valves are processed by the computer, with the at least one shaping-board weight being taken into account, wherein an effective pressure for an advancing shaping board is maintained, during the advance, at least from an advancing value corresponding to a thickness of the article to be ironed and positioned on the other shaping board.

9. The ironing machine of claim 7 wherein the high-pressure source is pneumatic.

10. The ironing machine of claim 7 wherein the high-pressure source is hydraulic.

11. The ironing machine as claimed in claim 1, wherein pressure valves of a lower and of an upper pressure chamber of the cylinder are sensed by pressure sensors and are fed into the control device, and wherein control values for pairs of aerating and deaerating valves are processed by the computer, with the at least one shaping-board weight being taken into account, wherein an effective pressure for an advancing shaping board is maintained, during the advance, at least from an advancing value corresponding to a thickness of the article to be ironed and positioned on the other shaping board.

12. The ironing machine as claimed in claim 11, wherein values for the at least one shaping board weight relative to the at least one shaping board ironing surface are taken into account in the adjustment of the ironing pressure and are preset on a setting unit.

* * * * *